US006030257A

United States Patent [19]

Furuya

[11] Patent Number: 6,030,257

[45] Date of Patent: Feb. 29, 2000

[54] FUSE HOLDER

[75] Inventor: Yoshinobu Furuya, Shizuoka-ken, Japan

[73] Assignee: Yazaki Corporation, Tokyo, Japan

[21] Appl. No.: 09/033,616

[22] Filed: Mar. 3, 1998

[30] Foreign Application Priority Data

Mar. 11, 1997 [JP] Japan ..... 9-056522

[51] Int. Cl.[7] ..... H01R 13/68

[52] U.S. Cl. ..... 439/621

[58] Field of Search ..... 439/621, 622

[56] References Cited

U.S. PATENT DOCUMENTS

| | | | |
|---|---|---|---|
| 5,314,354 | 5/1994 | Nomura et al. | 439/621 |
| 5,645,448 | 7/1997 | Hill | 439/621 |
| 5,700,165 | 12/1997 | Harris et al. | 439/621 |
| 5,816,850 | 10/1998 | Yamada et al. | 439/621 |

FOREIGN PATENT DOCUMENTS

| | | |
|---|---|---|
| UM 5-69848 | 9/1993 | Japan . |
| UM 7-41947 | 7/1995 | Japan . |

*Primary Examiner*—Gary F. Paumen
*Attorney, Agent, or Firm*—Finnegan, Henderson, Farabow, Garrett & Dunner, L.L.P.

[57] ABSTRACT

A fuse holder (24) in accordance with the present invention comprises a fuse receiving case (29) made of a thermosetting resin and receiving a fuse body (26) therewithin, a pair of fixing portion (31) integrally formed with the fuse receiving case (29) and to which a fuse terminal portion (27) is screwed together with a bus bar (32) or a terminal (34) of an end of an electric wire and a cover (30) closing an inner portion of the fuse receiving case (29). Accordingly, the fuse body is received within the fuse receiving case.

7 Claims, 2 Drawing Sheets

FUSE HOLDER

BACKGROUND OF THE INVENTION

1. Field of the Invention

The present invention relates to a fuse holder fixing a fuse, and more particularly to a fuse holder preferably used for fixing a fuse for a heavy current.

2. Description of the Related Art

A fuse having a heavy capacity (approximately 300 A) used for an electric automotive vehicle in a related art comprises a cylindrical fuse and L-shaped terminal portions connected to both side portions of the fuse body, and a mounting hole is formed in each of the fuse terminal portions.

On the contrary, in fuse holders to which the fuse is fixed, one end is fixed to a connecting box body by a mounting bolt. The other ends (upper surface ends) of the fuse holders are formed as a fixing surface. Further, a screw hole open to the fixing surface is formed on each of the fuse holders.

Then, in a state of fixing the fuse holders to the connecting box body, the end portion of the bus bar is mounted on the fixing surface of one of the fuse holders, one of the fuse terminal portions of the fuse is overlapped thereon, and the fuse mounting bolt is inserted thereinto so as to be meshed with the screw hole. As in the same manner, the end portion of the bus bar is mounted on the fixing surface of the other of the fuse holders, the other of the fuse terminal portions of the fuse is overlapped thereon, and the fuse mounting bolt is inserted thereinto so as to be meshed with the screw hole. Finally, by fastening the fuse mounting bolt, the fuse is fixed to the fuse holders and is fixed to the connecting box body.

However, in the fixing structure for the fuse mentioned above, since each of the fuse holders which is separated into two portions is fixed to the connecting box body by the mounting bolt, a pitch accuracy of the screw holes between the fuse holders is deteriorated, so that a position adjustment is required between the fuse holders at a time of screwing the fuse terminal portions of the fuse. Accordingly, there is a problem that a mounting operability is bad at a time of mounting the fuse to the connecting box body.

In order to solve the problem, Japanese Utility Model Unexamined Application Laid Open No. 7-41947 and No. 5-69848 suggest that the end of the bus bar is directly screwed to the connecting box body together with the terminal portion of the fuse without using an independent fuse holder.

In the fixing structure for the fuse described in Japanese Utility Model Unexamined Application Laid Open No. 7-41947, in a pair of terminal portions disposed in both sides of the fuse body of the fuse, the end portion of the bus bar is overlapped on the insulating plate, the terminal portions are respectively overlapped thereon and the terminal portions of the fuse fixed onto the insulating plate together with the bus bars by the screw. In accordance with this structure, since the fuse holder is not used, a time and labor for mounting the fuse holder can be saved and it is unnecessary to adjust the pitch between the terminal portions, a good operability for mounting the fuse can be obtained.

In the fuse mounting structure described in Japanese Utility Model Unexamined Application Laid Open No. 5-69848, as in the same manner as that of the publication mentioned above, the end portion of the bus bar and the terminal portion of the fuse are directly screwed on the insulating plate in an overlapping manner, so that the fuse is directly fixed to the insulating plate without using the fuse holder so as to be electrically connected to the bus bar. In this structure, the time and labor for mounting the fuse holder can be saved and the good operability for mounting the fuse can be obtained.

However, in each of the structures mentioned above, since the fuse is fixed onto the fuse holders and each of the insulating plates together with the bus bar in a bare state, there is a risk that at a time of assembling the other electric parts on the connecting box body or on the insulating plates, the other electric parts are erroneously brought into contact with the fuse or an unreasonable force is given to the fuse so that the fuse is broken.

Further, since the electrical connecting portion with the bus bar is in a bare state, when a electrically conductive foreign substance is erroneously entered into the connecting box body, there is a possibility of forming an electrical connection.

SUMMARY OF THE INVENTION

The present invention has been achieved with such points in view.

It therefore is an object of the present invention to provide a fuse holder which can protect a fuse body and a fuse terminal portion of a fuse at a time of mounting a peripherally relevant electric parts and can improve a mounting operability.

To achieve the object, according to a first aspect of the present invention, there is provided a fuse holder for holding a fuse in such a manner that first and second terminal portions projecting from a fuse body of the fuse are each fixed to the fuse holder together with either an end portion of a bus bar or a terminal of an end of an electric wire, comprising: a fuse receiving case made of a thermosetting resin for receiving the fuse body therewithin when in the assembled state; first and second fixing portions integrally formed with the fuse receiving case and screwed to which one of the first and second fuse terminal portions and either the bus bar or the terminal end electric wire are screwed together respectively; and a cover closing an inner portion of the fuse receiving case.

In the fuse holder in accordance with the first aspect of the present invention, since the fuse body is received within the fuse receiving case, the peripherally relevant electric parts are not erroneously brought into contact with the fuse body at a time of mounting the peripheral electric part, so that the fuse can be securely protected.

Further, in this fuse holder, it is not necessary to adjust the pitch shift at a time of screwing a pair of fuse terminal portions to a pair of fixing portions integrally formed with the fuse receiving case, so that the mounting operability is improved.

According to a second aspect of the present invention, as it depends from the first aspect, the fixing portion is provided in the inner portion of the fuse receiving case.

In the fuse holder in accordance with the second aspect, since a pair of fixing portions are provided within the fuse receiving case, the fuse terminal portion is not in a bare state. Accordingly, a reliability in the electrical connection can be improved.

According to a third aspect of the present invention, as it depends from the first or the second aspect, the fuse receiving case is formed with an insertion opening to receive the end portion of the bus bar or the terminal end of the electric wire therethrough; and the cover has a seal wall closing the insertion opening in a sealing manner.

In the fuse holder in accordance with the third aspect, the inner portion of the fuse receiving case is sealed by the cover and the sealing wall provided in the cover. Accordingly, the fuse body received therewithin, the fuse terminal portion and the end portion of the bus bar or the terminal of the end of the electric wire, are protected.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 1 is an exploded perspective view which shows an embodiment of a fuse holder in accordance with the present invention; and FIG. 2 is a cross sectional view showing a state in which a fuse is fixed to the fuse holder in accordance with the present invention and an end portion of a bus bar and a terminal of an end of an electric wire are connected.

DETAILED DESCRIPTION OF THE PREFERRED EMBODIMENTS

Figure 1:
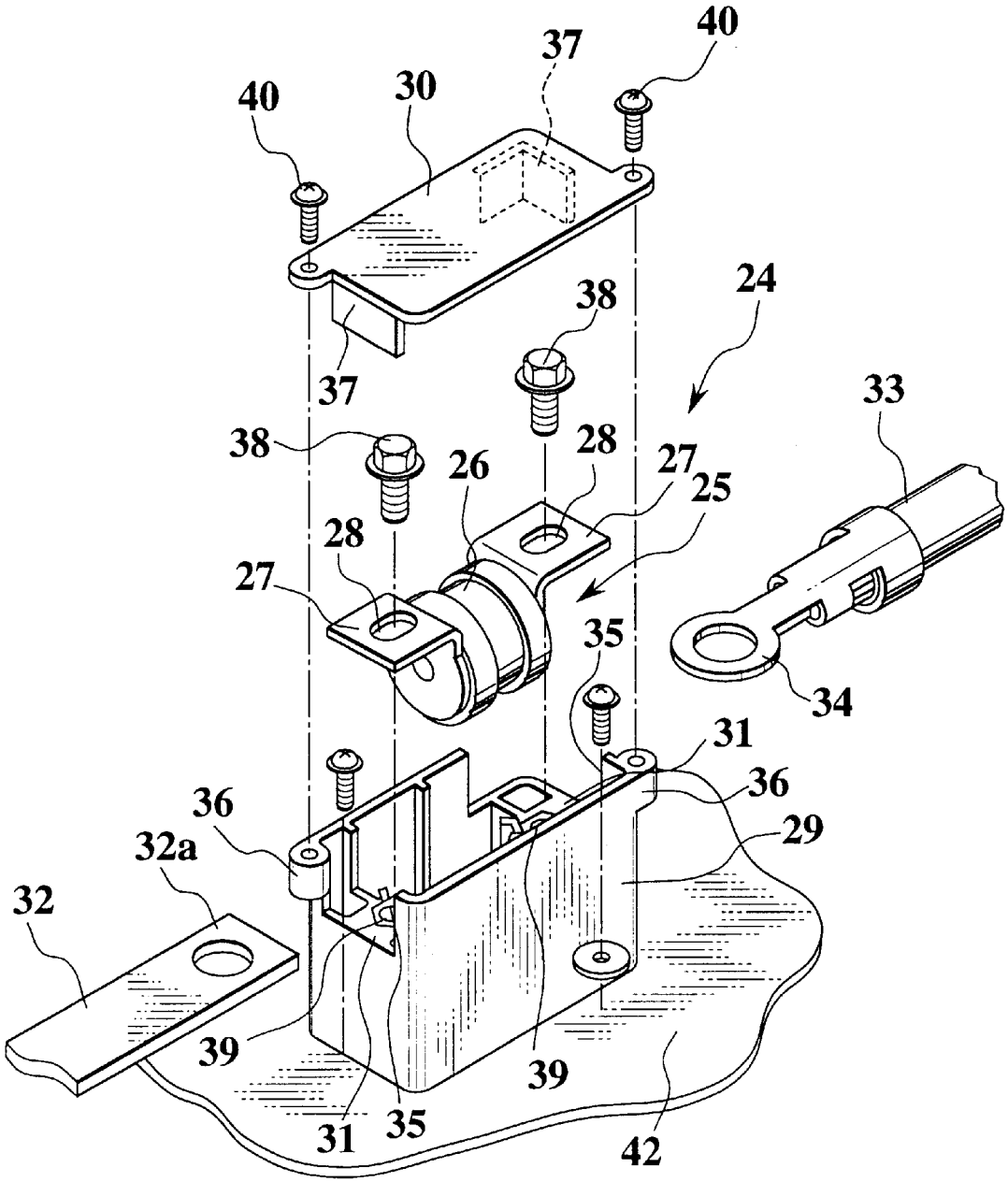

There will be detailed below the preferred embodiments of the present invention with reference to the accompanying drawings. Like members are designated by like reference characters.

Figure 2:
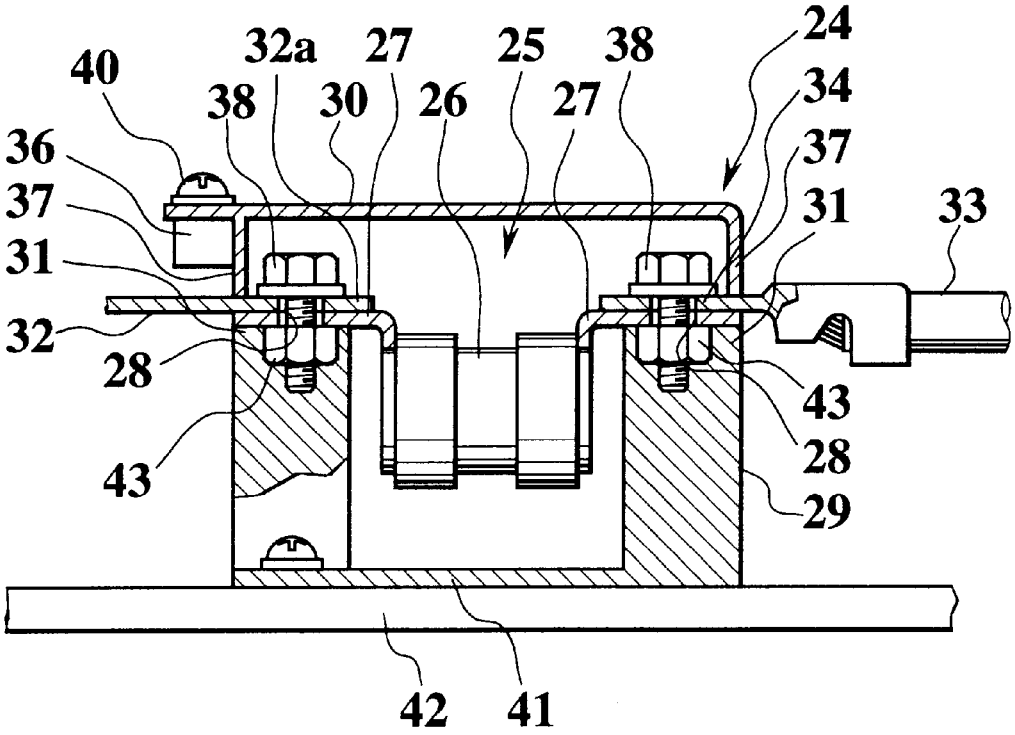

In this case, FIG. 1 is a perspective view which shows a fuse holder 24 and a fuse 25 fixed to the fuse holder 24, and FIG. 2 is a cross sectional view showing a state in which the fuse 25 is fixed to the fuse holder 24.

At first, the fuse 25 fixed to the fuse holder 24 in accordance with this embodiment will be described below. The fuse 25 comprises a cylindrical fuse body 26 having a fusion portion and the like installed therewithin and a pair of L-shaped fuse terminal portions 27 and 27 connected to both side portions of the fuse body 26. Mounting holes 28 and 28 are respectively formed in the fuse terminal portions 27 and 27. In this case, the fuse 25 is a heavy capacity type (approximately 300 Ampere) used for an electric automotive vehicle.

The fuse holder 24 to which the fuse 25 is fixed comprises a box-like fuse receiving case 29 having an open upper portion and a cover 30 closing an opening formed in the upper portion of the fuse receiving case 29. A pair of fixing portions 31 and 31 are formed in first and second opposing inner walls of the fuse receiving case 29. A periphery of a pair of fixing portions 31 and 31 are cut out in a rectangular shape so that inserting openings 35 and 35 to which an end portion 32*a* of a bus bar 32 and a terminal 34 of an end of an electric wire 33 are inserted are formed. Screw holes 39 and 39 are respectively formed in a pair of fixing portions 31 and 31 and insert nuts 43 and 43 are respectively inserted into middle portions thereof.

A cover fixing portions 36 and 36 to which the cover 30 is screwed are respectively formed in the opening edge portion of the fuse receiving case 29 at opposing positions.

Further, the cover 30 is a planner plate shape, and sealing walls 37 and 37 capable of closing the inserting openings 35 and 35 of the fuse receiving case 29 from a lower surface end are provided in a projecting manner.

Still further, the fuse receiving case 29 and the cover 30 are respectively made of a thermosetting resin having a characteristic with respect to an arc resistance, a tracking resistance and a heat resistance.

Next, a procedure of fixing the fuse 25 to the fuse holder 24 in accordance with this embodiment and connecting the end portion 32*a* of the bus bar 32 and the terminal 34 of the end of the electric wire 33 to the fuse terminal portions 27 and 27 will be described below.

At first, the fuse body 26 is received within the fuse receiving case 29 and the fuse terminal portions 27 and 27 are mounted on a pair of fixing portions 31 and 31. At this time, the end portion 32*a* of the bus bar 32 and the terminal 34 of the end of the electric wire are respectively inserted into the portion between a pair of fixing portions 31 and 31 and a pair of terminal portions 27 and 27.

Next, the fuse mounting bolts 38 and 38 are inserted into a pair of terminal portions 27 and 27, the end portion 32*a* of the bus bar 32 and the terminal 34 of the end of the electric wire, and are respectively meshed with the screw holes 39 and 39 of a pair of fixing portions 31 and 31 so as to be fastened.

Then, the upper opening of the fuse receiving case 29 is closed by the cover 30. At this time, the inserting openings 35 and 35 are closed by the sealing walls 37 and 37. Further, the cover 30 is fixed to the cover fixing portions 36 and 36 by bolts 40 and 40. In this state, as shown in FIG. 2, the fuse body 26 is received in a state of being sealed within the fuse receiving case 29, and further the fuse 26 is fixed to the fuse holder 24 in a state that the fuse terminal portions 27 and 27 are fixed to the fuse holder 24, and is electrically connected to the end portion 32*a* of the bus bar 32 and the terminal 34 of the end of the electric wire.

In this case, the fuse holder 24 can be disposed within an electric connecting box by screwing a bottom wall 41 of the fuse receiving case 29 to a connecting box body 42 of the electric connecting box (not shown). In this case, the screw fixed to the connecting box body 42 extends through the bottom wall 41 within the fuse receiving case 29 and is meshed with the connecting box body 42.

In accordance with the fuse holder 29 of this embodiment, since the fuse body 26 and the fuse terminal portions 27 and 27 are received within the fuse receiving case 29, at a time of mounting a peripheral electric part, the electric part is not directly brought into contact with the fuse body 26 and the fuse terminal portions 27 and 27, thereby securely protecting.

Further, the fuse terminal portions 27 and 27 are also received within the fuse receiving case 29, even when the foreign substance erroneously enters into the connecting box body 42, the trouble such that the fuse terminal portions 27 and 27 are electrically connected to each other can be securely prevented from generating.

Still further, in the fuse holder 24 in accordance with this embodiment, a pair of fixing portions 31 and 31 are integrally formed with the fuse receiving case 29, so that the pitch between the screw holes 39 and 39 of the fixing portions 31 and 31 can be accurately set. Accordingly, since it is not necessary to adjust the position of the fuse, the operability of mounting the fuse is improved.

Furthermore, the fuse receiving case 29 is integrally formed with the connecting box body 42, so that it is unnecessary to mount the independent fuse holder 24 to the connecting box body 42, thereby further improving the mounting operability.

Moreover, since in the fuse receiving case 29 in accordance with this embodiment, the screw extending through the bottom wall 41 within the fuse receiving case 29 is meshed with the connecting box body 42 so as to be fixed to the connecting box body 42, the mounting portion, the screw and the like for mounting the fuse holder do not project, thereby saving the space.

Further, even in the case that an extremely excess current in comparison with the capacity of the fuse 25 flows, the fusion portion within the fuse body 26 is abruptly broken and the outer shell portion of the fuse body 26 disperses, in accordance with the fuse holder 24 of this embodiment, since the fuse body 26 is received within the fuse receiving case 29, the dispersed substance does not fall on the other electric part and does not give an influence.

Still further, as mentioned above, even when the fusion portion within the fuse body 26 is abruptly broken and the temperature of the fuse body 26 unusually becomes high, since the fuse holder 24 is made of a thermosetting resin having a high heat resistance, the fuse holder 24 is not melted and is not burnt down. As a result, the damage does not extend to the other electric part.

Furthermore, even when the outer shell of the fuse body 26 which is normally filled with the sand for preventing the arc disperses and the sand is leaked, the leaked sand stays within the fuse receiving case 29 and does not go out from the fuse receiving case 29, so that the peripheral electric part is not affected.

While preferred embodiments of the present invention have been described using specific terms, such description is for illustrative purposes, and it is to be understood that changes and variations may be made without departing from the spirit or scope of the following claims.

What is claimed is:

1. A fuse holder for holding a fuse in such a manner that first and second terminal portions projecting from a fuse body of the fuse are each fixed to the fuse holder together with either an end portion of a bus bar or a terminal end of a electric wire when in an assembled state, comprising:

a fuse receiving case made of a thermosetting resin for receiving the entire fuse body therewithin when in the assembled state;

first and second fixing portions integrally formed with the fuse receiving case and each respectively screwed to one of the first and second fuse terminal portions together with either the end portion of the bus bar or the terminal end of the electric wire when in the assembled state; and a cover closing an inner portion of the fuse receiving case.

2. The fuse holder according to claim 1, wherein the first and second fixing portions are provided in the inner portion of the fuse receiving case.

3. The fuse holder according to claim 2, wherein the fuse receiving case is formed with an insertion opening to receive either the end portion of the bus bar or the terminal end of the electric wire therethrough; and wherein the cover has a seal wall closing the insertion opening in a sealing manner.

4. The fuse holder according to claim 1, wherein the fuse receiving case has first and second opposing side walls, the first fixing portion comprises a first inner wall extending inward from the first opposing side wall, and the second fixing portion comprises a second inner wall extending inward from the second opposing side wall.

5. The fuse holder according to claim 1, wherein each of the first and second fixing portions extend parallel to the each of the first and second terminal portions projecting from the fuse body when the fuse body is received within the fuse receiving case.

6. The fuse holder according to claim 1, wherein the first fixing portion extends parallel to the end portion of the bus bar when the first terminal portion is screwed together with the end portion of the bus bar.

7. The fuse holder according to claim 1, wherein the second fixing portion extends parallel to the terminal end of the electric wire when the second terminal portion is screwed together with the terminal end of the electric wire.

* * * * *

UNITED STATES PATENT AND TRADEMARK OFFICE

CERTIFICATE OF CORRECTION

PATENT NO. : 6,030,257
DATED : February 29, 2000
INVENTOR(S) : FURUYA

It is certified that error appears in the above-identified patent and that said Letters Patent is hereby corrected as shown below:

*On the Title Page, Item [57], in the Abstract, line 4, "portion", should read --portions--.*

*Claim 1, column 5, line 35, "a electric", should read --an electric--.*

Signed and Sealed this

Tenth Day of April, 2001

*Attest:*

Nicholas P. Godici

NICHOLAS P. GODICI

*Attesting Officer*

*Acting Director of the United States Patent and Trademark Office*